United States Patent [19]

Nishiumi et al.

[11] Patent Number: 4,964,517

[45] Date of Patent: Oct. 23, 1990

[54] PRINTED PAPER DISPENSING APPARATUS AND METHOD OF CONTROLLING SAID APPARATUS

[75] Inventors: Kenji Nishiumi; Toru Kassara; Yoshikazu Mori; Eiji Itako, all of Saitama, Japan

[73] Assignee: Kabushiki Kaisha Nippon Conlux, Tokyo, Japan

[21] Appl. No.: 328,474

[22] Filed: Mar. 24, 1989

[30] Foreign Application Priority Data

Mar. 24, 1988 [JP] Japan ..... 63-70733
Mar. 24, 1988 [JP] Japan ..... 63-70734

[51] Int. Cl.[5] ..... B07C 5/342; B07C 5/02
[52] U.S. Cl. ..... 209/534; 271/303
[58] Field of Search ..... 209/534; 271/303; 414/788.7, 793.9, 797.6, 797.7

[56] References Cited

U.S. PATENT DOCUMENTS 4,423,826 1/1984 Hirata et al. ..... 271/303 X
4,447,714 5/1984 Lundblad ..... 194/206 X
4,540,081 9/1985 Mori et al. ..... 209/534 X
4,564,140 1/1986 Kokubo et al. ..... 232/57.5
4,709,820 12/1987 Jenkins et al. ..... 209/534
4,747,493 5/1988 Nakanishi ..... 209/534
4,784,274 11/1988 Mori et al. ..... 209/534

FOREIGN PATENT DOCUMENTS 58-39392 3/1983 Japan .
61-11155 4/1986 Japan .
64-2210 1/1989 Japan .

*Primary Examiner*—Russell D. Stormer
*Attorney, Agent, or Firm*—Spensley Horn Jubas & Lubitz

[57] ABSTRACT

A printed paper dispensing apparatus for dispensing a predetermined number of printed papers in the form of bank notes, tickets or the like printed matter and a method of controlling the foregoing apparatus. In a case where a required number of bank notes move past abnormal bank note detecting sensors without abnormal bank notes detected thereby so that they are placed one above another in a layered structure on a belt conveyer, all the bank notes on the belt conveyer are conveyed to a dispensing outlet port after a predetermined period of time elapses after the last bank note has moved past the abnormal bank note detecting sensors. In a case where an abnormality is detected with the respective bank notes while they are placed on the belt conveyer in that way, the bank notes are introduced into an abnormal bank note receiving portion. Further, the bank notes on the belt conveyer are inched slightly in the direction opposite to the dispensing outlet port before they are conveyed to the dispensing outlet port in order to prevent the bank notes from standing upright on the belt conveyor.

19 Claims, 19 Drawing Sheets

PRINTED PAPER DISPENSING APPARATUS AND METHOD OF CONTROLLING SAID APPARATUS

BACKGROUND OF THE INVENTION

1. Field of the Invention

The present invention relates to a printed paper dispensing apparatus for dispensing a predetermined number of printed papers in the form of bank notes, tickets or the like and a method of controlling the foregoing apparatus. More particularly, the present invention relates to a printed paper dispensing apparatus which assures that a predetermined number of printed papers in the form of bank notes, tickets or the like are conveyed to a dispensing outlet port without fail and a method of controlling the foregoing apparatus.

2. Description of the Related Art

A hitherto known printed paper dispensing apparatus used as a money exchanger, a ticket vender or the like is disclosed in, e.g., an official gazette of Japanese Utility Model Publication No. 22,028/1985. The apparatus disclosed in the official gazette is of a type employing a blade wheel. In detail, the apparatus is so constructed that a predetermined number of printed papers drawn from the interior of a printed paper receiving portion are once placed one above another in a layered structure in alignment with each other while they are separated from each other one by one via a blade wheel and then all the printed papers arranged in that way are conveyed to a dispensing outlet port using a belt conveyer, rollers or the like means.

However, it has been found that the conventional apparatus gives an incorrect amount to users or controllers of the apparatus, because when two printed papers superposed one above another or abnormal printed papers each having an irregular shape are delivered to the blade wheel, there arises a problem that they are conveyed to the dispensing outlet as they are or the apparatus is clogged by them.

Another problem appearing in the conventional apparatus is that printed papers are sometimes accumulated while some stand upright in an accumulating region, after they are individually separated from each other by the blade wheel. In this case, all the printed papers can not be simultaneously conveyed to the dispensing outlet port due to the presence of the printed paper which stands upright in the accumulating region, resulting in a required number of printed papers failing to be correctly dispensed thereto. The apparatus may be clogged with them under the circumstances.

SUMMARY OF THE INVENTION

The present invention has been made with the foregoing background in mind and its object resides in providing a printed paper dispensing apparatus which assures that a predetermined number of printed papers are conveyed to a dispensing outlet port without fail without any unexpected damage given to users or controllers of the apparatus.

Another object of the present invention is to provide a printed paper dispensing apparatus which assures that printed papers to be accumulated in an accumulating region lie flat thereon without fail so that a predetermined number of printed papers are conveyed to the dispensing outlet port.

Another object of the present invention is to provide a method of properly controlling the aforementioned printed paper dispensing apparatus.

To accomplish the above objects, the present invention provides a printed paper dispensing apparatus comprising drawing means for drawing printed papers in a printed paper receiving portion from the interior of the latter one by one, abnormality detecting means for detecting an abnormality with the respective printed papers which have been drawn by the drawing means in that way, accumulating means adapted to individually separate the respective printed papers which have moved past the abnormality detecting means so as to allow them to be placed one above another in a layered structure in an accumulating region, conveying means for conveying all the printed papers in the accumulating region to a dispensing outlet port after a predetermined period of time elapses after the last printed paper moves past the abnormality detecting means, in a case where a required number of printed papers have moved past the abnormality detecting means without abnormal printed papers being detected by the latter, and introducing means for introducing printed papers in the accumulating region into an abnormal printed paper receiving portion after a predetermined period of time elapses after drawing of the printed papers by the drawing means is interrupted, in a case where an abnormality is detected with the respective printed papers by the abnormality detecting means while they are accumulated in the accumulating region.

Further, according to the present invention, the apparatus is provided with controlling means for inching the printed papers in the accumulating region in the opposite direction to the dispensing outlet port before they are conveyed to the latter.

In a case where a required number of printed papers move past the abnormality detecting means without abnormal printed papers detected by the abnormality detecting means, all the printed papers in the accumulating region are conveyed to the dispensing outlet port after a predetermined period of time elapses after the last printed paper moves past the abnormality detecting means. On the other hand, in a case where an abnormality is detected with the respective printed papers by the abnormality detecting means while they are accumulated in the accumulating region, drawing operation of the printed papers by the drawing means is interrupted immediately and thereafter printed papers are introduced into the abnormal printed papers receiving portion after a predetermined period of time elapses.

The printed papers in the accumulating region are inched in the opposite direction to the dispensing outlet port before they are conveyed to the latter. This assures that a printed paper which stands upright in the accumulating region is tilted down onto the latter, resulting in all the printed papers being conveyed to the dispensing outlet port without fail.

In this manner, the present invention provides a printed paper dispensing apparatus which is free from a malfunction that printed papers remain midway of the conveying passage and which assures that printed papers can smoothly be conveyed to the dispensing outlet port.

These and other objects and features and advantages of the present invention will be readily apparent from a reading of the following description which has been made with reference to the accompanying drawings.

BRIEF DESCRIPTION OF THE DRAWINGS

The present invention will be illustrated in the following drawings in which.

DESCRIPTION OF THE PREFERRED EMBODIMENT

Now, the present invention will be described in a greater detail hereinafter with reference to the accompanying drawings which illustrate a preferred embodiment thereof.

Figure 1:
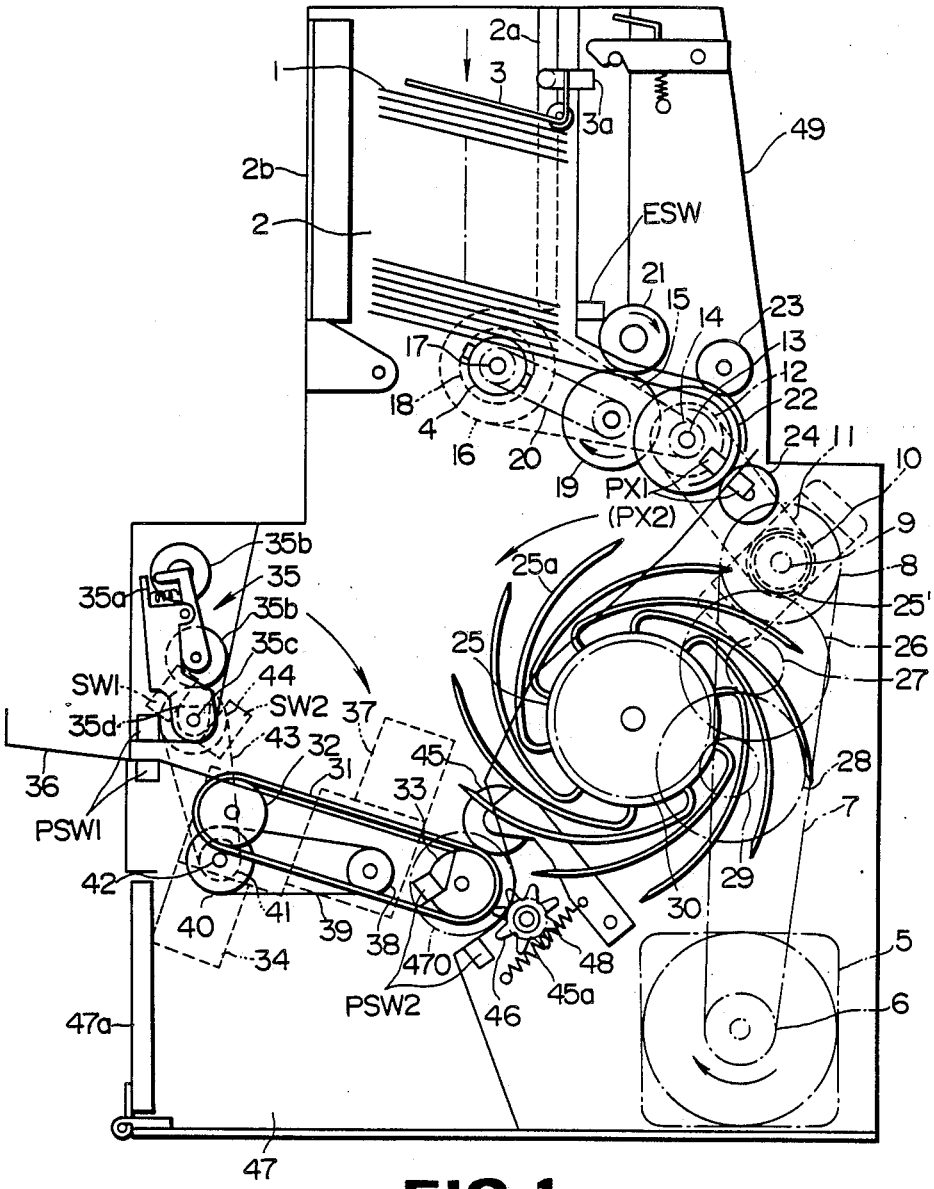
FIG. 1 is a side view of a bank note dispensing apparatus in accordance with an embodiment of the present invention, shown with a side cover removed therefrom.
Figure 2:
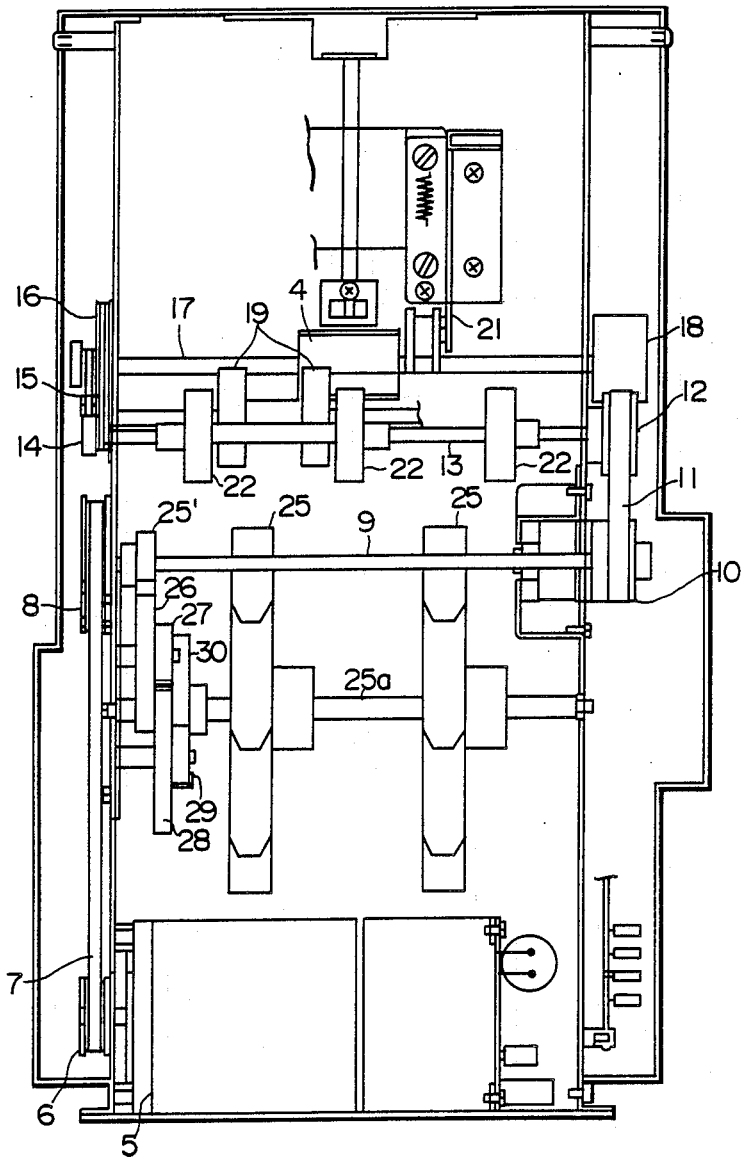
FIG. 2 is a view illustrating the apparatus in FIG. 1, as seen from the back side.

FIGS. 1 and 2 illustrate a money exchanger in which a bank note dispensing apparatus in accordance with the present invention is incorporated, wherein FIG. 1 is a side view of the exchanger with an outer cover removed therefrom and FIG. 2 is a view showing the exchanger as seen from the back side. A number of bank notes 1 representative of printed papers to be dispensed from the exchanger are received in a bank note receiving portion 2 in a layered structure. The bank note receiving portion 2 is provided with a weight 3 adapted to slide downward along a guide 2*a* to depress the bank notes 1 from the above. The bank notes 1 in the bank note receiving portion 2 are drawn from the lowest part of the layered structure one by one by means of a roller 4. The roller 4 is driven by a first motor 5 via a pulley 6, a belt 7, a pulley 8, a shaft 9, a clutch 10, a belt 11, a pulley 12, a shaft 13, a pulley 14, a belt 15, a pulley 16 and a shaft 17. A brake 18 is mounted on the shaft 17 for the purpose of controlling the driving of the roller 4.

A pair of rollers 19 are operatively associated with the roller 4 via a belt 20 and a pair of rollers 21 are arranged above the roller 19. An one-way clutch (not shown) is provided for the roller 21 so that among the layered bank notes to be conveyed, bank notes exclusive the lowermost one are inhibited from being conveyed. Consequently, only the lowermost bank note is drawn from the bank note receiving portion 2. This bank note moves between rollers 22 fixedly mounted on the shaft 13 and rollers 23 kept in slidable contact with the rollers 22 as well as between the rollers 22 and rollers 24 kept in slidable contact with the rollers 22 until it is introduced into a space between adjacent blades 25*a* on a blade wheel 25.

It should be noted that the respective rollers 19 and 22 are designed to have a diameter larger than that of the roller 4 and an amount of feeding by the rollers 19 and 22 is determined larger than that by the roller 4. This causes the bank notes which have been drawn by the roller 4 to be arranged one after another in an equally spaced relationship as viewed in the direction of movement of the bank notes. This is intended to facilitate detecting of the respective bank notes by sensors PX1 and PX2 which will be described later.

The blade wheel 25 is rotated in the anticlockwise direction by the first motor 5 via the pulley 6, the belt 7, the pulley 8, a first gear 25 coaxially mounted on the shaft for the pulley 8, a second gear 26, a third gear 27 coaxially mounted on the shaft for the second gear 26, a fourth gear 28, a fifth gear 29 coaxially mounted on the shaft of the fourth gear 28 and a sixth gear 30 coaxially mounted on the shaft 25*a* for the blade wheel 25.

A single bank note held between the respective adjacent blades 25*a* on the blade wheel 25 is parted away from the blade wheel 25 so that bank notes are successively placed one above another in a layered structure on a belt conveyer 31. The belt conveyer 31 extends between pulleys 32 and 33 so that it can be driven in both normal and reverse directions by a second motor 34 via the pulley 32. In fact, a plurality of belt conveyers 31 each having same structure are arranged in parallel to each other, although they are not clearly shown in the drawings for the purpose of simplification of illustration.

A thrust roller 35 is constructed by plural pairs of rollers 35*b* arranged in parallel to each other, each of the rollers 35*b* being retracted by a spring 35*a*. The thrust roller 35 is tilted in the direction identified by an arrow mark in FIG. 1 when bank notes on the belt conveyer 31 are to be conveyed toward a dispensing outlet port 36. The thrust roller 35 is driven by a third motor 37 via a pulley 38, a belt 39, a pulley 40, a shaft 42, a pulley 41, a belt 43 and a pulley 44.

A thrust roller 45 adapted to be biased onto the belt conveyer 31 under the effect of resilient force of a spring 45*a* is provided in a region where the pulley 33 is arranged. In addition, a gear 46 made of elastic material to draw abnormal bank notes into an abnormal bank note receiving portion 47 is provided in the vicinity of the belt conveyer 31. The gear 46 is driven by the second motor 34 via the pulley 32, the belt conveyor 31, the pulley 33 and gears 470 and 48.

The bank note receiving portion 2 includes a door 2*b* adapted to be turned about a shaft 2*c* to the front side, as shown in FIG, 3. When the door 2*b* is opened, the weight 3 is displaced upwardly along the guide 2*a* via a link 2*d* so that a number of bank notes can easily be received in a layered structure in the open space located under the weight 3 in the bank note receiving portion 2.

Figure 3:
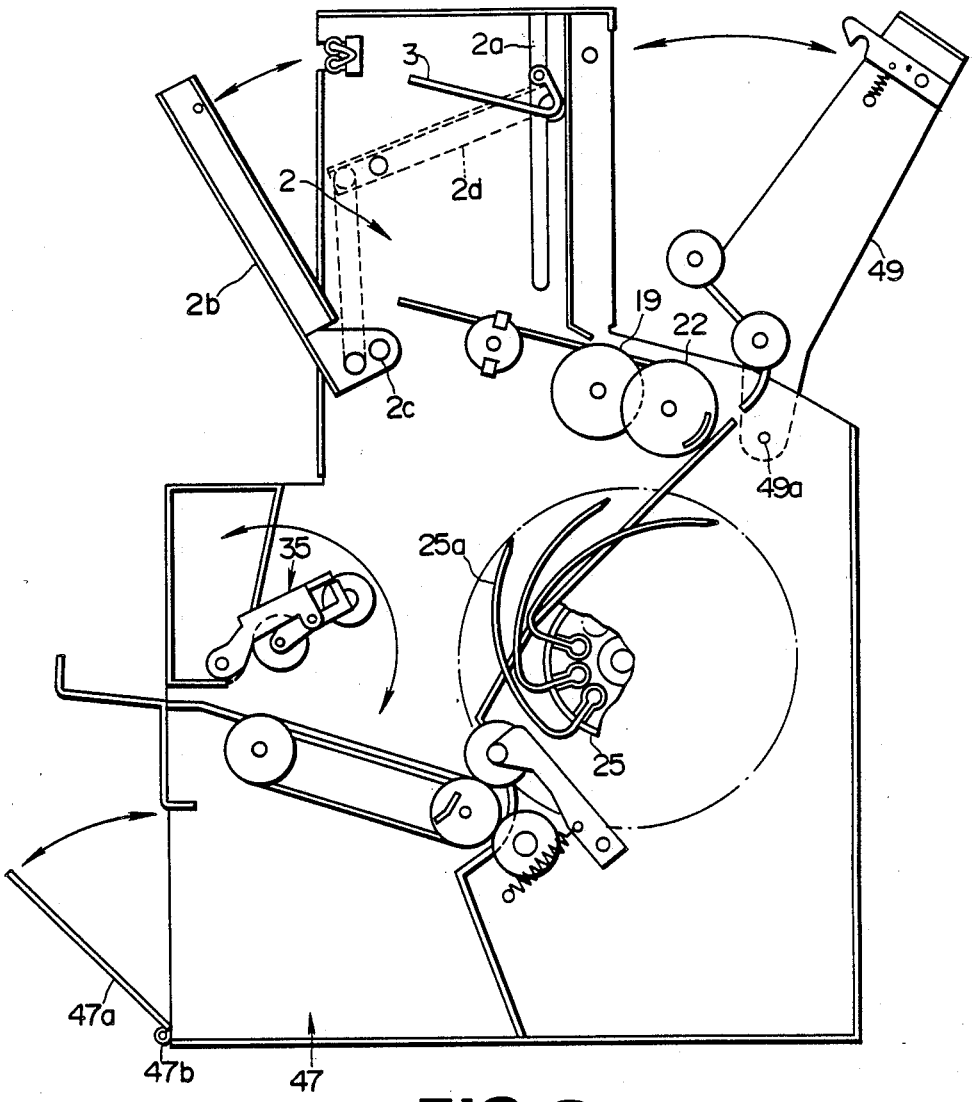
FIG. 3 is a side view of the apparatus, schematically illustrating that essential components constituting the apparatus are turned to their opened state.

A back cover 49 can be opened by turning it about a shaft 49*a* in the backward direction, as shown in FIG. 3. This permits the bank notes to be removed from a region where the rollers 19 and 22 are arranged, if the apparatus is clogged with them for some reason.

As is best seen in FIG. 3, the blades 25*a* are fitted in the hub portion of the blade wheel 25 by displacing them in the axial direction. This arrangement makes it possible to easily replace damaged or injured blades 25*a* with new ones.

The abnormal bank note receiving portion 47 includes a front door 47*a* adapted to be opened by turning it about a shaft 47*b* so that abnormal bank notes in the abnormal bank note receiving portion 47 can be removed therefrom.

The thrust roller 35 can be turned about a shaft 35*c* in the direction as identified by an arrow mark in FIG. 1.

In the illustrated embodiment, the apparatus of the present invention is equipped with a plurality of sensors for the purpose of controlling operations of the first motor 5, the second motor 34, the third motor 37, the clutch 10 and the brake 18.

Next, detailed description will be made below as to these sensors.

An empty switch ESW is disposed at the lower part of the bank note receiving portion 2. This empty switch ESW is intended to detect the fact that the number of bank notes received in a layered structure in the bank note receiving portion 2 is reduced less than a predetermined one (hereinafter referred to as an empty). For example, the empty switch ESW comprises an optical sensor adapted to detect the empty by detecting the presence of a protrusion 3*a* protruding outwardly of the weight 3.

Two abnormal bank note detecting sensors PX1 and PX2 for detecting an abnormality with the respective bank notes drawn in that way (in the form of two bank notes superposed one above another, abnormality of bank note in shape or the like) are disposed in a region where the rollers 22 and 24 are provided for the purpose of conveying the bank notes drawn from the bank note receiving portion 2. Specifically, each of the sensors PX1 and PX2 comprises an optical sensor adapted to detect an abnormality with the respective bank notes in the form of two bank notes superposed one above another, abnormality of bank note in shape or the like with reference to the time when a certain bank note has moved past the sensors PX1 and PX2, the delayed timing of detection performed thereby or the like parameter.

Figure 4:
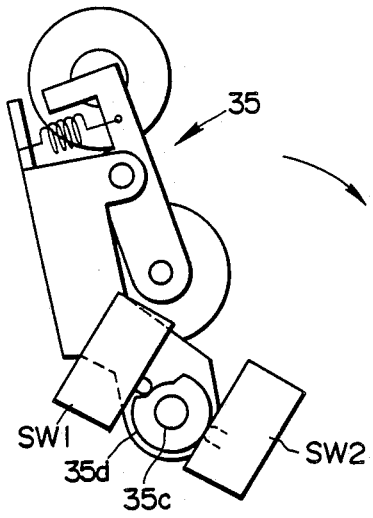
FIGS. 4(*a*) and 4(*b*) are a side view of a thrust roller, respectively, illustrating a manner of detecting two positions assumed by the thrust roller.
Figure 4:
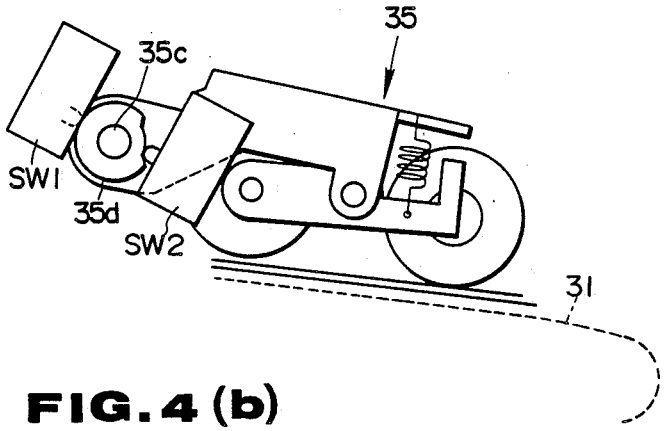

Further, the apparatus of the present invention is equipped with switches SW1 and SW2 which are disposed on the pivotal shaft 35*c* of the thrust roller 35 to detect the current position where the thrust roller 35 has been turned. Each of the switches SW1 and SW2 comprises a limit switch which is actuated by a cam 35*d* fixedly mounted on the shaft 35*c*. FIGS. 4(*a*) and 4(*b*) illustrate a state assumed by the switches SW1 and SW2 in an enlarged scale, respectively. As long as the thrust roller 35 is kept in an inoperative state, i.e., in a waiting state as shown in FIG. 1, the switch SW2 is turned on by the cam 35*d* while the switch SW1 is turned off, as shown in FIG. 4(*a*). Next, when the thrust roller 35 is turned in the direction identified by the arrow mark in FIG. 1 until it assumes a state where it depresses the layered structure of bank notes on the belt conveyer 31, the result is that the switch SW1 is turned on by the cam 35*d* while the switch SW 2 is turned off, as shown in FIG. 4(*b*).

An outlet sensor PSW1 is disposed in the proximity of the dispensing outlet port 36 so as to allow all the bank notes conveyed to the outlet port 36 by the belt conveyer 31 to be detected. This sensor PSW1 comprises an optical sensor.

An abnormal bank note removal confirming sensor PSW2 is disposed in the proximity of the pulley 33 so that among the bank notes conveyed by the belt conveyer 31, abnormal bank notes to be introduced into the abnormal bank note receiving portion 47 are detected. The sensor PSW2 comprises an optical sensor too.

Figure 5:
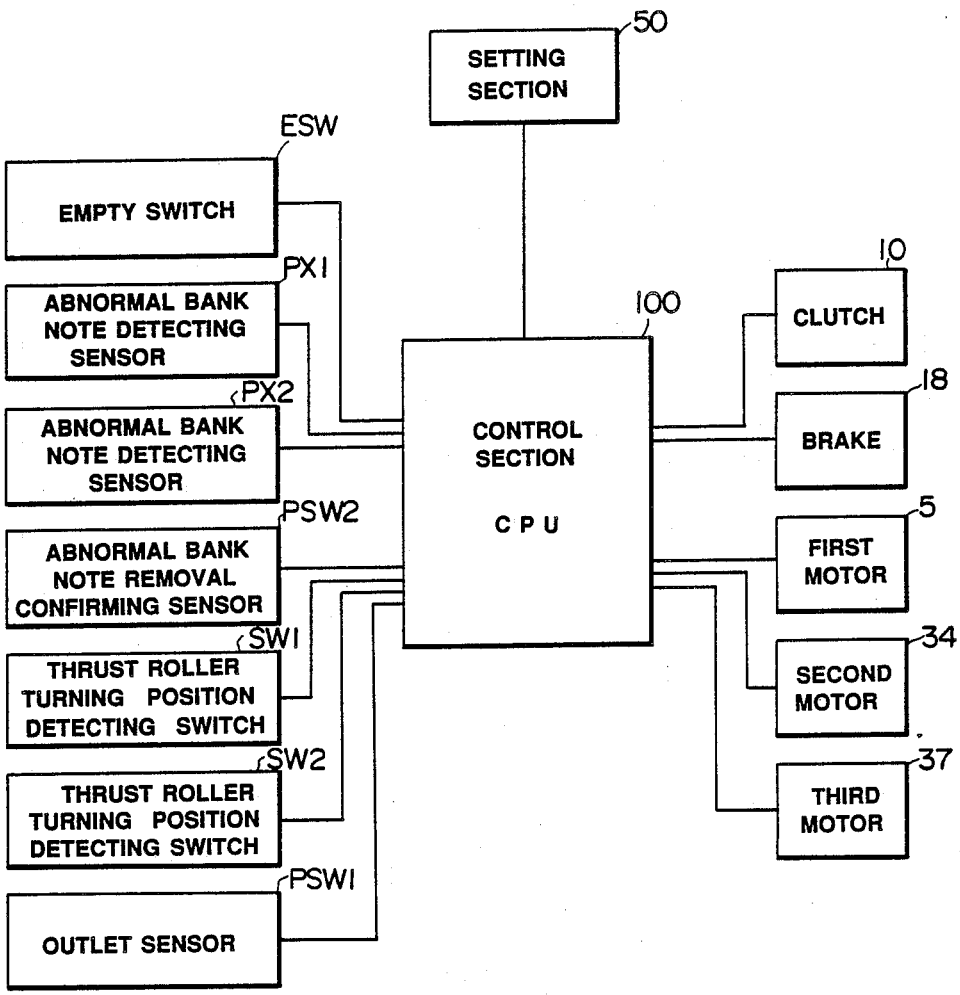
FIG. 5 is a block diagram illustrating by way of example a control system for the apparatus.

FIG. 5 illustrates by way of block diagram the structure of a control system for the apparatus in accordance with this embodiment. Outputs from the aforementioned sensors, i.e., the switch ESW, the switches PX1 and PX2, the switches SW1 and SW2 and the sensors PSW1 and PSW2 are introduced into a control section (hereinafter referred to CPU) 100. Data indicative of the number of bank notes to be dispensed from the apparatus are inputted in the CPU 100, wherein the number of bank notes has been previously set in a setting section 50. The CPU 100 controls operations of the first motor 5, the second motor 34, the third motor 37, the clutch 10 and the brake 18 on the basis of outputs from a number of sensors ESW, PX1, PX2, SW1, SW2, PSW1 and PSW2 as well as data set in the setting section 50.

Now, a manner of performing control operations with the CPU 100 will be described below in more details with reference to flowcharts in FIGS. 6 to 11 and drawings in FIGS. 12 to 19.

First, the number N of bank notes to be dispensed from the apparatus is set in a counter (not shown), wherein the number N of bank notes to be dispensed has been previously set in the setting section 50 (step 101). This counter is incorporated in the CPU 100 either in a hardware fashion or in a software fashion. Subsequently, the clutch 10 is turned off (step 102) and the brake 18 is turned on (step 103). Then, while the foregoing state is maintained, the first motor 5 starts its rotation. Since the clutch 10 is turned off and the brake 18 is turned on, the blade wheel 25 starts its rotation but the roller 4 is not rotated and also the rollers 19 and 22 are not rotated.

At the same time when the first motor 5 starts its rotation, a timer (not shown) starts its operation (step 105). This timer is incorporated in the CPU 100 either in a hardware fashion or in a software fashion. When a period of 300 milliseconds has elapsed after the starting of operation of the timer (step 106), the brake 18 is turned off (107) and the clutch 10 is turned on (step 108). This causes the roller 4 and the rollers 19 and 22 to start their rotation whereby a step of drawing of the bank notes from the interior of the bank note receiving portion 2 is started.

It should be noted that a period of 300 milliseconds from the starting of rotation of the first motor 5 untill the starting of rotation of the roller 4 represents a period of idling which elapses until the first motor 5 assumes a stable rotational speed (i.e., until the blade wheel 25 assumes a stable rotational speed).

The bank notes drawn from the bank note receiving portion 2 by the roller 4 are distributed in the form of a single bank note in an equally spaced relationship as viewed in the direction of movement of the bank notes by means of the rollers 19 as well as the rollers 21 of which rotational direction is defined by the one-way clutch. Thereafter, the singularly distributed bank note reaches via the rollers 22 and 23 the position where the sensors PX1 and PX2 are disposed so that inspection is performed as to whether it is normal or abnormal. In detail, first, when it is detected that the sensors PX1 and PX2 are turned on (step 109), a determination is made on the basis of outputs from the sensors PX1 and PX2 as to whether or not an abnormality in the form of two bank notes superposed one above another occurs among the bank notes conveyed from the roller 4 (step 110). When it is found that the abnormality in the form of two bank notes superposed one above another does not occur, a detection is made as to whether the sensors PX1 and PX2 are turned off or not (step 111). When it is found that the sensors PX1 and PX2 are turned off, a determination is then made on the basis of outputs from them as to whether the bank notes are abnormal or not in shape (step 112).

In a case where it is determined at the step 110 that the abnormality in the form of two bank notes superposed one above another occurs or in a case where it is determined at the step 112 that the bank notes are abnormal in shape, the program jumps to a step 151 which will be described later. If it is determined at the step 112 that the bank notes are normal, the program goes to a step 113 in FIG. 7 so that a step of processing for resetting the state of the counter to N−1 is executed. Subsequently, a determination is made as to whether a condition of N=0 is established or not. If it is found that the condition of N−1 is not established, the program returns to the step 109 in FIG. 6 so that the same inspection as mentioned above is performed for the bank notes which are to be subsequently conveyed from the roller 4.

Figure 12:
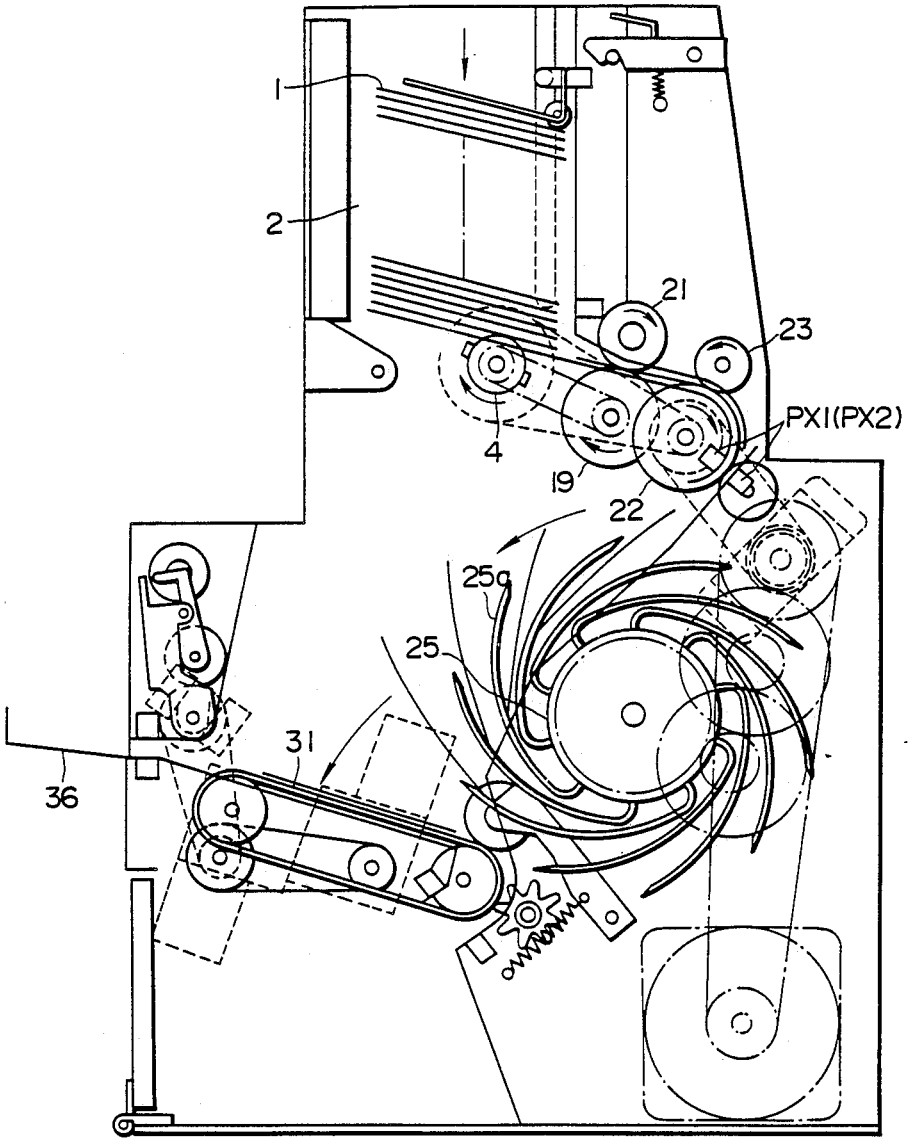

After the bank notes move past the sensors PX1 and PX2, they reach the blade wheel 25 so that they are successively introduced into adjacent blades 25*a* on the blade wheel 25 one by one. Thereafter, the bank note held between the adjacent blades 25*a* is disengaged therefrom toward the belt conveyer 31 as the blade wheel 25 is rotated whereby the bank notes are placed thereon one above another to build a layered structure. FIG. 12 illustrates the foregoing state.

When it is determined at a step 114 that a condition of N=0 is established, i.e., the number of conveyed bank notes reaches N which has been set initially, the clutch 10 is turned off (step 115) and then the brake 18 is turned on (step 116) so that rotation of the roller 4 and the rollers 19 and 22 is interrupted and operation of the timer is started (step 117). When a period of 500 milliseconds elapses after the starting of operation of the timer (step 118), rotation of the first motor 5 is interrupted (step 119). This permits the number N of bank notes to be placed one above another in a layered structure on the belt conveyer 31.

Figure 13:
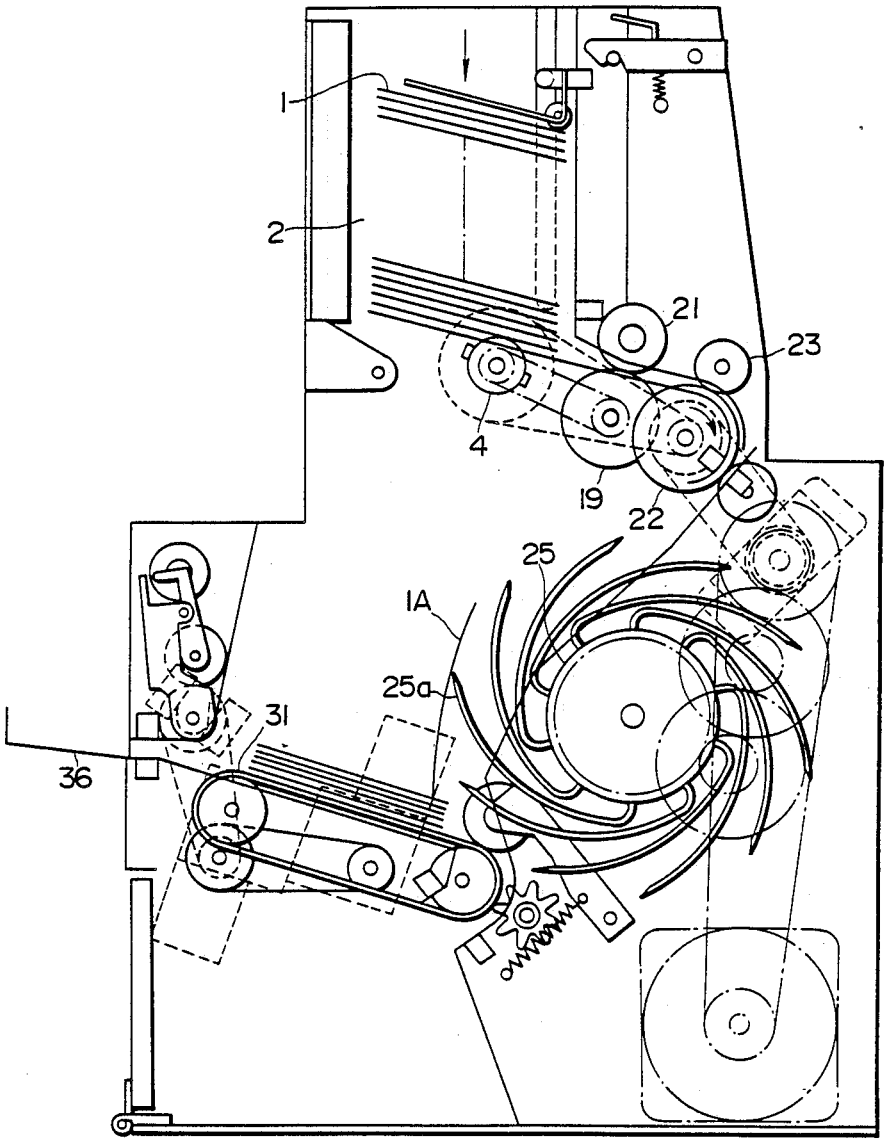
Figure 14:
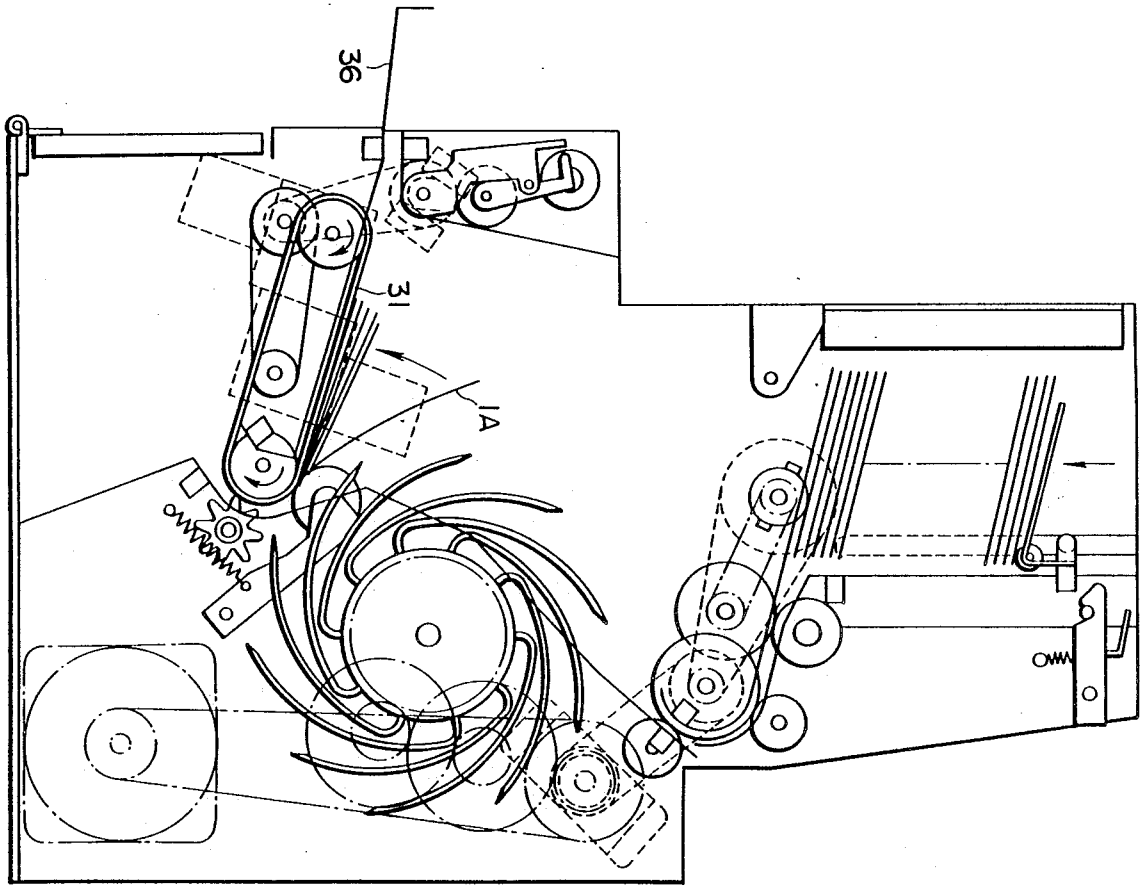

However, it should be noted that while the foregoing state is maintained, there sometimes arises such a malfunction that a single bank note (a bank note 1A in the illustrated case) stands upright on the belt conveyer 31, as shown in FIG. 13. In this case, to assure that the bank note 1A is tilted down onto the belt conveyer 31, the latter is operated in the direction opposite to the dispensing outlet port 36 for 100 milliseconds.

Namely, the second motor 34 is rotated in the reverse direction after rotation of the first motor 5 is interrupted at the step 119. This causes the belt conveyer 31 to be operated in the direction opposite to the dispensing outlet port 36 (the direction identified by an arrow mark), resulting in the bank note 1A which has stood upright being tilted down onto the conveyer belt 31 without fail.

Figure 15:
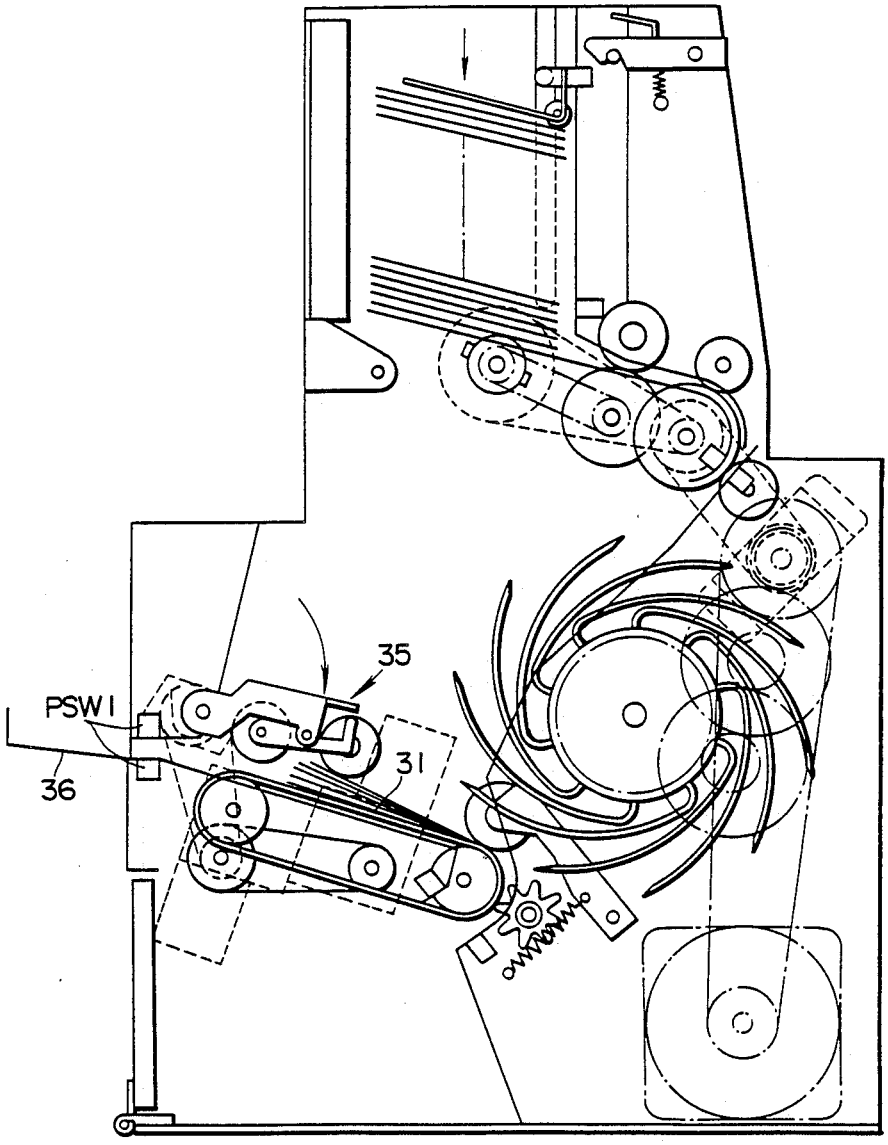
Figure 16:
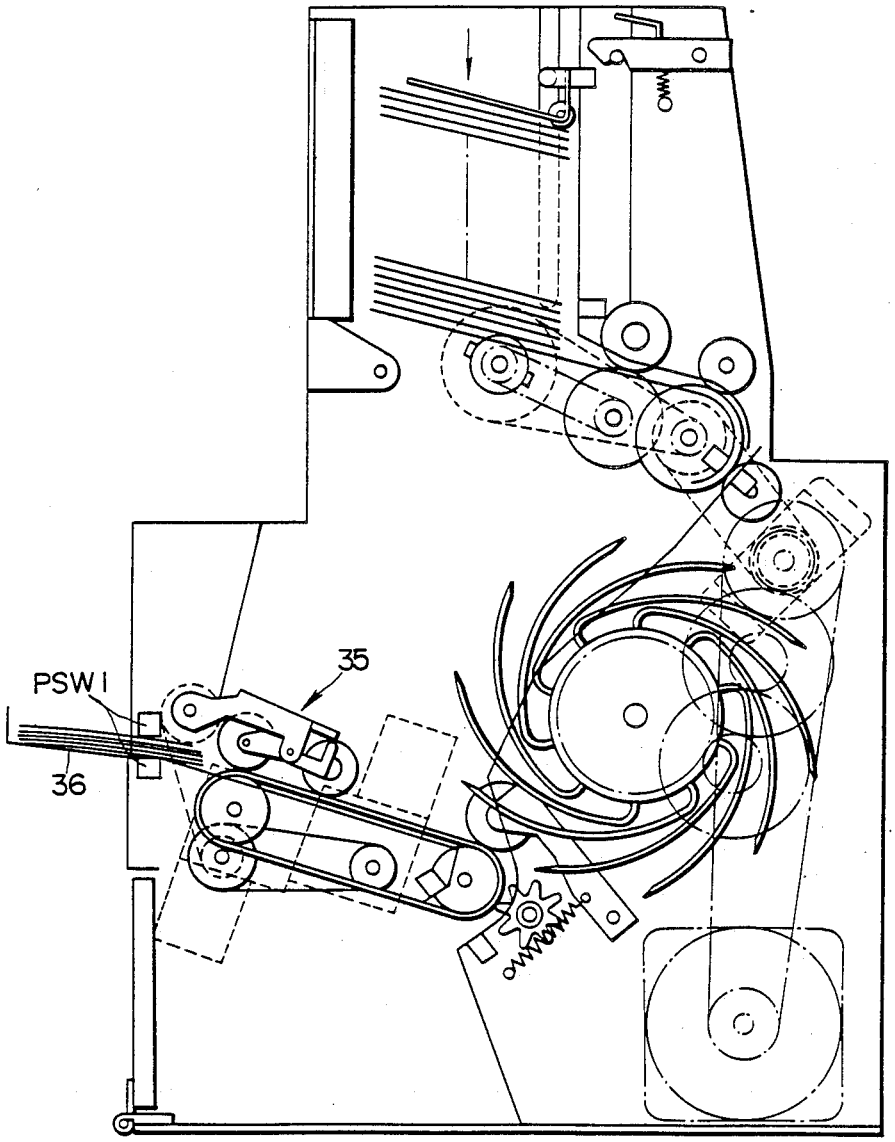

Operation of the timer is started in response to rotation of the second motor 34 in the reverse direction (step 121). When a period of 100 milliseconds elapses thereafter (step 122), rotation of the second motor 34 is interrupted (step 123) so that the third motor 37 is rotated in the normal direction (step 124). In response to rotation of the third motor 37 in the normal direction, the thrust roller 35 is turned toward the belt conveyer 31, as shown in FIG. 15. Then, when the switch SW2 is turned off by disengagement of the cam 35*d* disposed on the rotational shaft 35*c* of the thrust roller 35, rotation of the third motor 37 is interrupted so that the second motor 34 is subsequently rotated in the normal direction.

Figure 17:
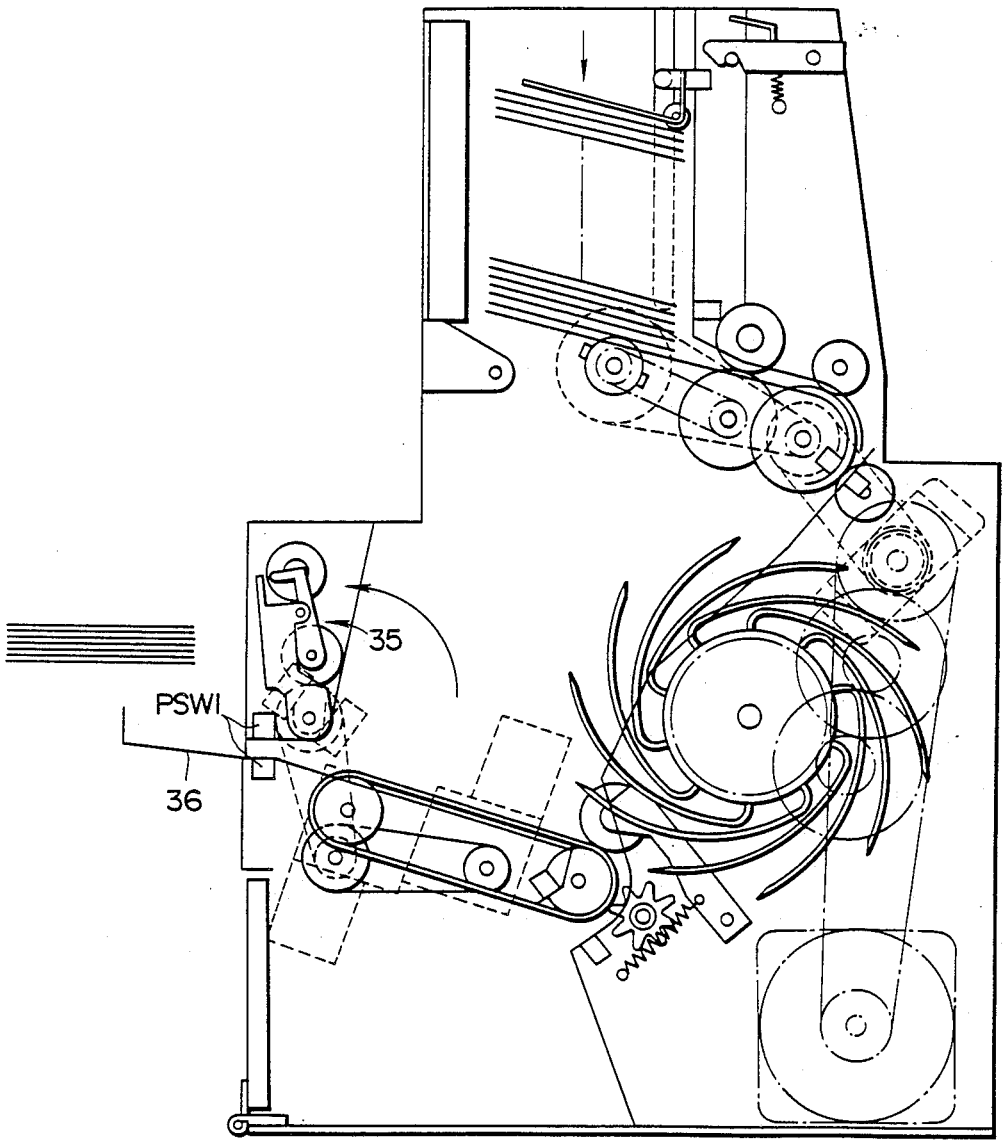
Figure 18:
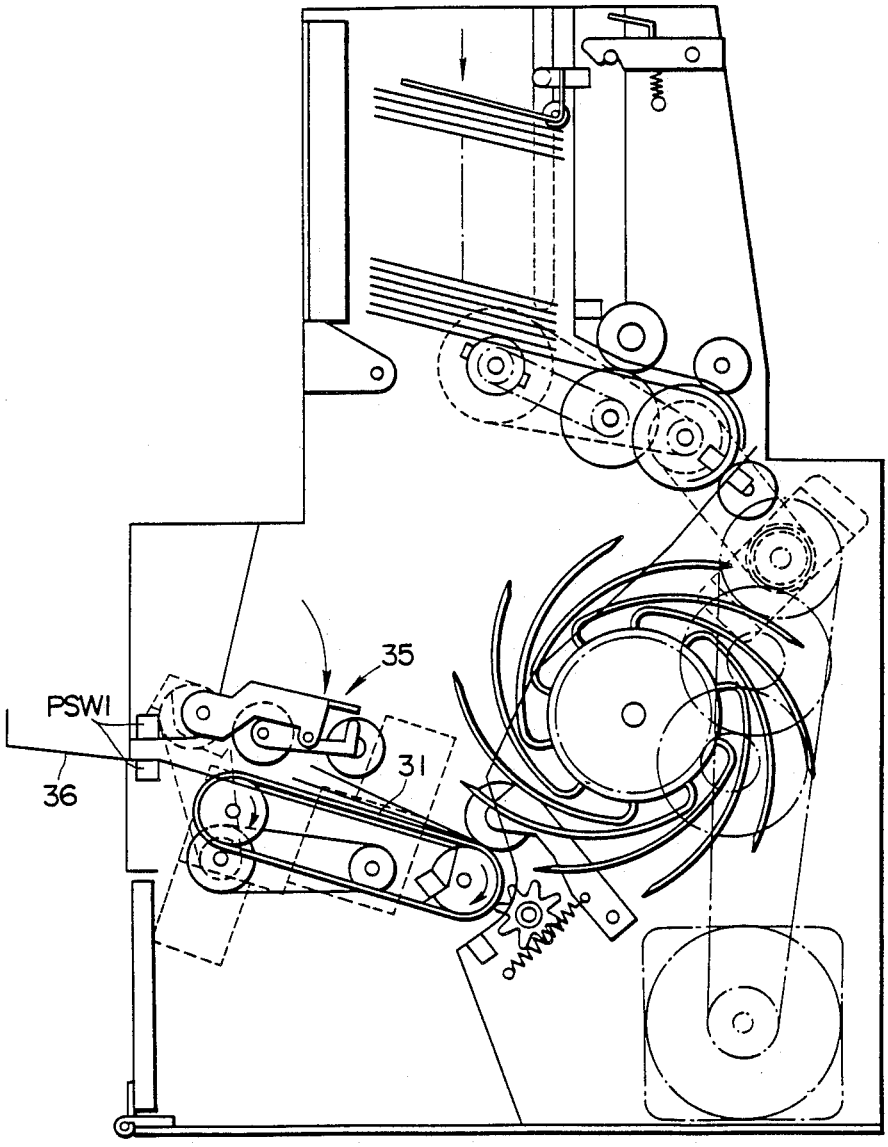
Figure 19:
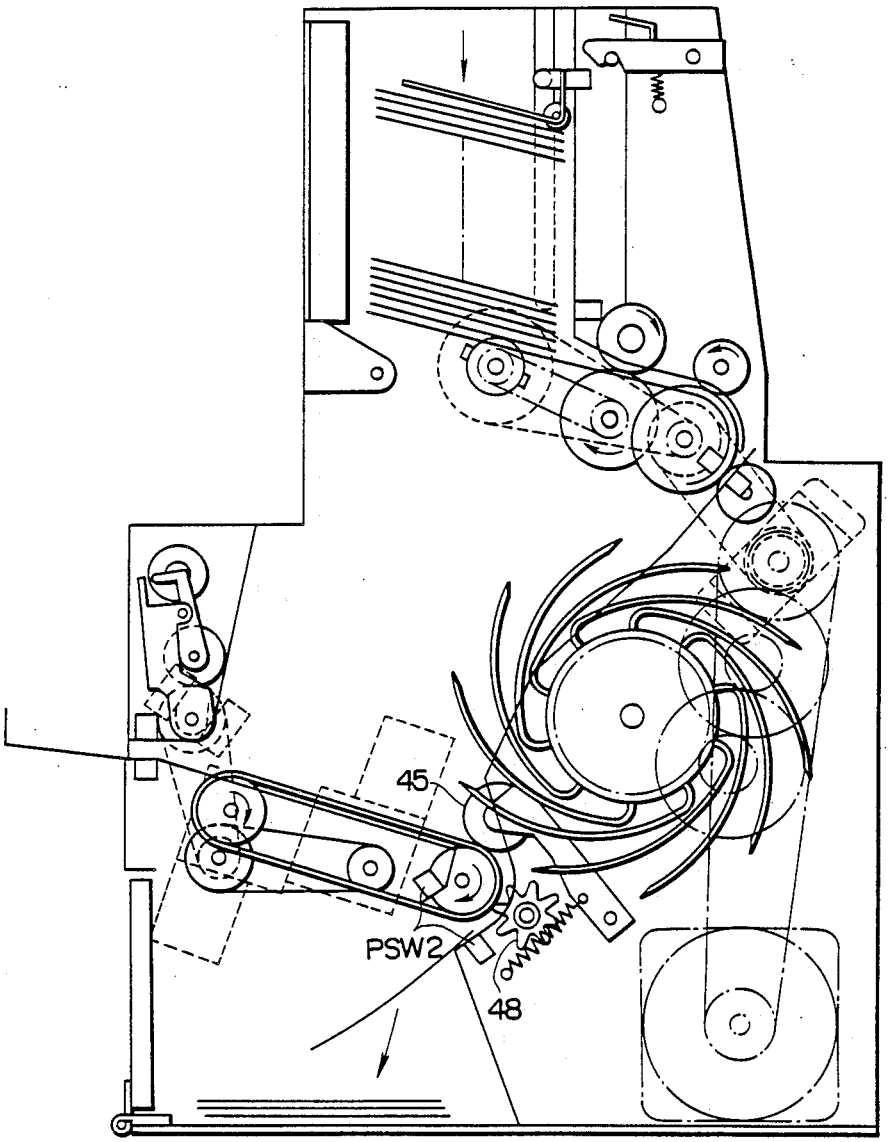

When it is detected by the sensor PSW 1 that the bank notes have been conveyed to the dispensing outlet port 36 (step 128), operation of the timer is started (step 129) and rotation of the second motor 34 is interrupted (step 131) after a period of 600 milliseconds elapses (step 130). As the second motor 34 is rotated in the normal direction, all the bank notes which have been placed one above another in a layered structure on the belt conveyer 31 are conveyed to the dispensing outlet port 36 (see FIG. 16). After rotation of the second motor 34 is interrupted, operation of the timer is started (step 132). If the sensor PSW1 fails to be turned off even after a period of 2 seconds elapses, i.e., if the bank notes at the dispensing outlet port 36 are not picked up and carried away by a customer, as shown in FIG. 17, rotation of the second motor 34 in the normal direction is started whereby the program returns to the step 129. Namely, the second motor 34 is rotated in the normal direction again for 600 milliseconds and this rotation of the second motor 34 is repeated until the bank notes are picked up from the dispensing outlet port 36. (It should be added that this operation is effective also for locating the bank notes in correct alignment with each other at the dispensing outlet port 36.)

When the bank notes which have been conveyed to the dispensing outlet port 36 are carried away before a period of 2 seconds elapses after rotation of the second motor 34 is interrupted (see FIG. 17), the second motor 34 is rotated in the normal direction again to confirm the presence or absence of residual bank notes (step 136). Additionally, operation of the timer is started again (step 137). When the sensor PSW1 is turned on again, the program returns to the step 129 so that the second motor 34 is rotated further in the normal direction for 600 milliseconds.

If the sensor PSW1 fails to be turned on even after a period of 600 milliseconds elapses after operation of the timer has been started again (step 137), rotation of the second motor 34 is interrupted (step 140) so that the third motor 37 is rotated in the reverse direction (step 141). When the switch SW1 is turned off by turning movement of the thrust roller 35 (step 142), rotation of the third motor 37 is interrupted (step 143). This permits the thrust roller 35 to be returned to the waiting position, as shown in FIG. 17. Thereafter, the counter is reset (step 144) and thereby the apparatus is kept in the waiting state.

Figure 6:
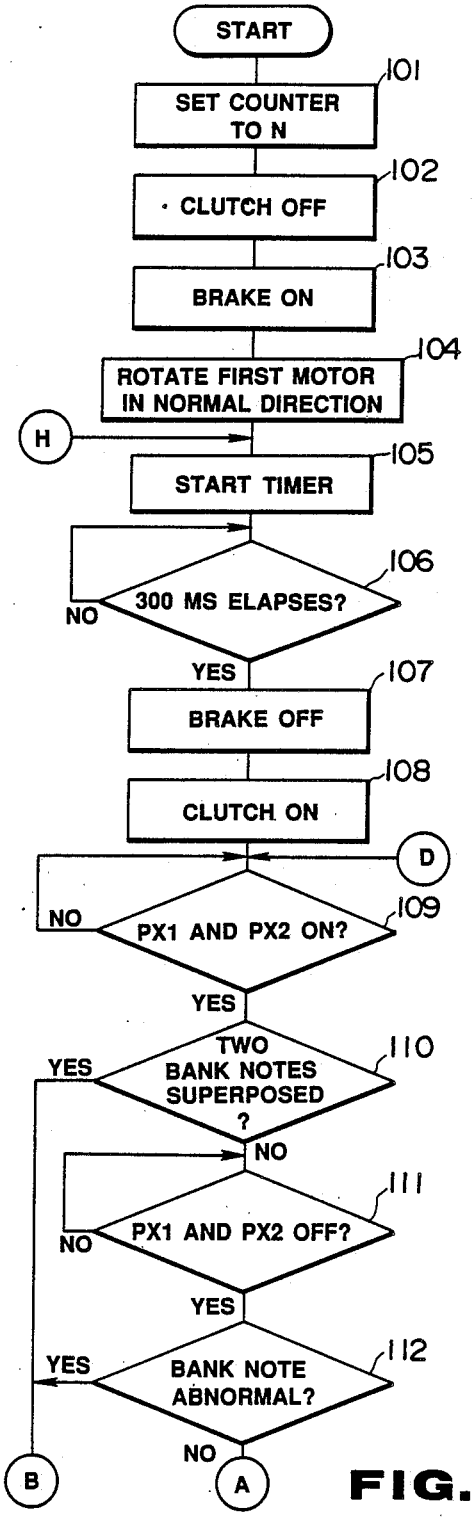
FIGS. 6 to 11 are a flowchart, respectively, illustrating operations of the control system in FIG. 5, and FIGS. 12 to 19 are a side view of the apparatus illustrating operations thereof, respectively.
Figure 7:
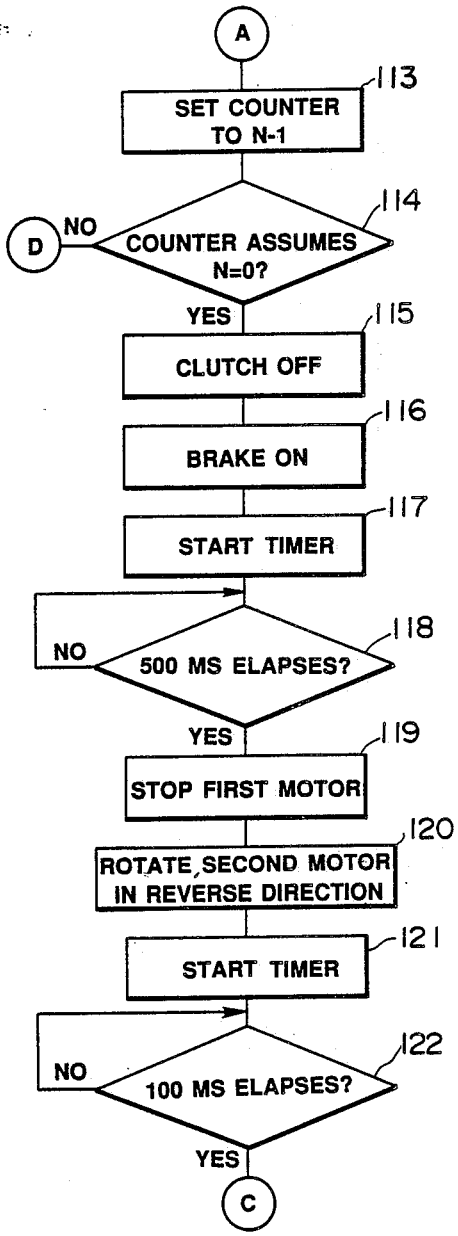
Figure 8:
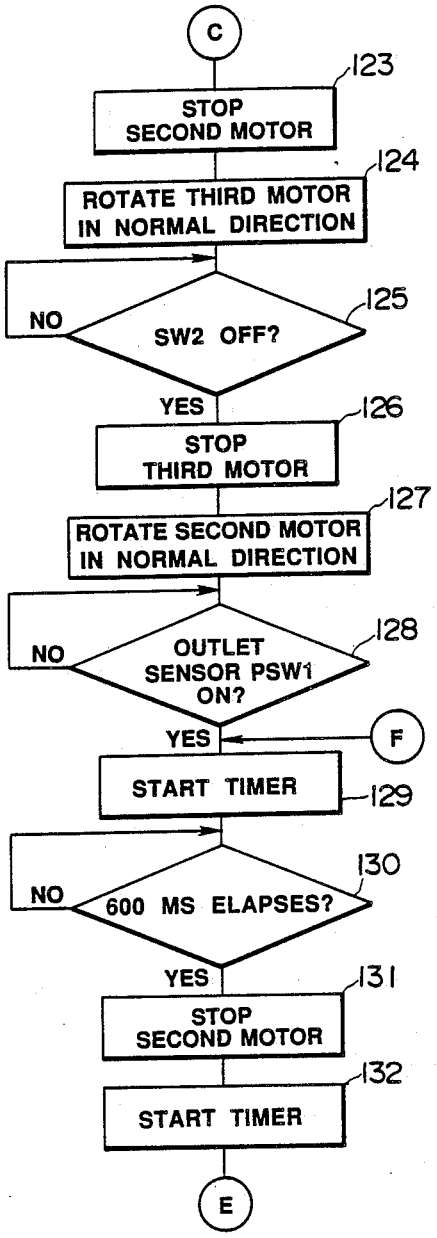
Figure 9:
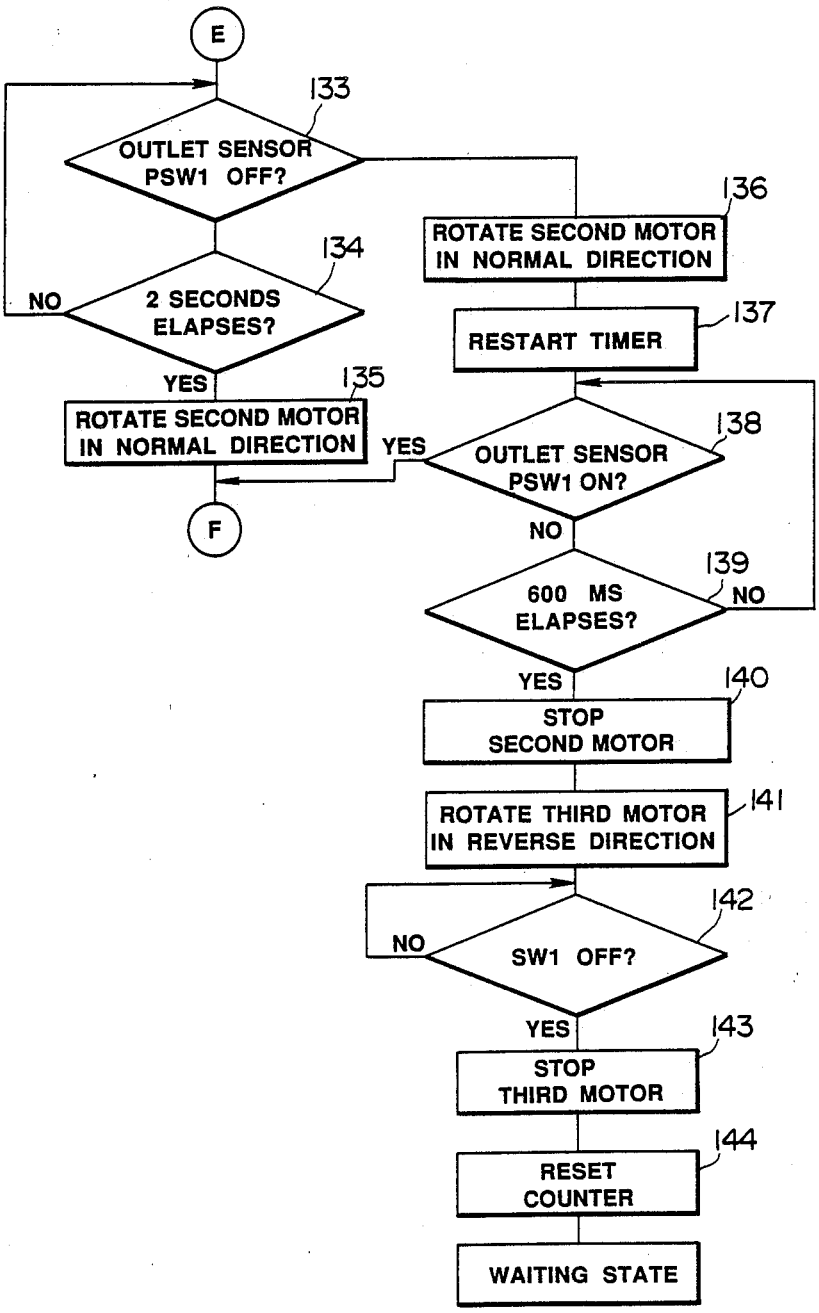
Figure 10:
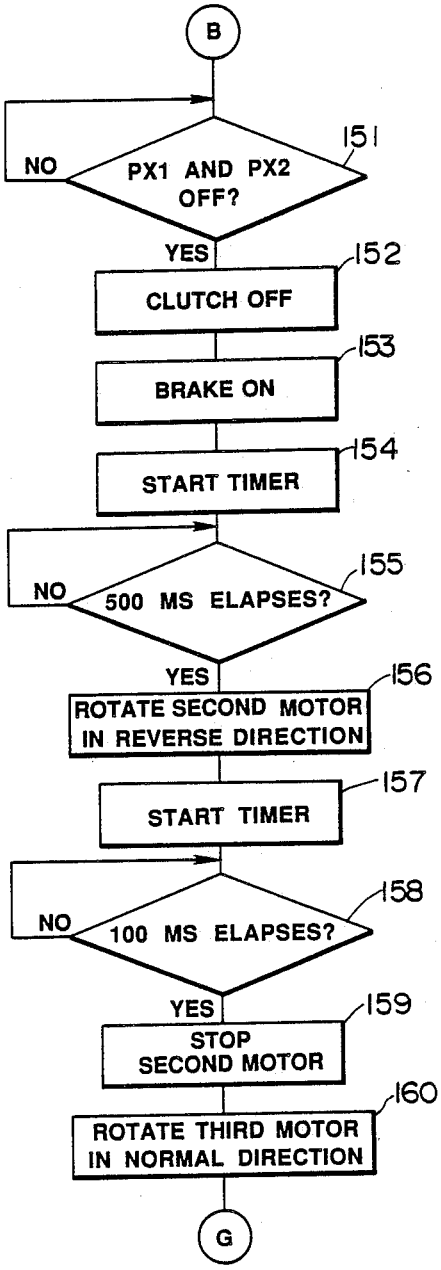
Figure 11:
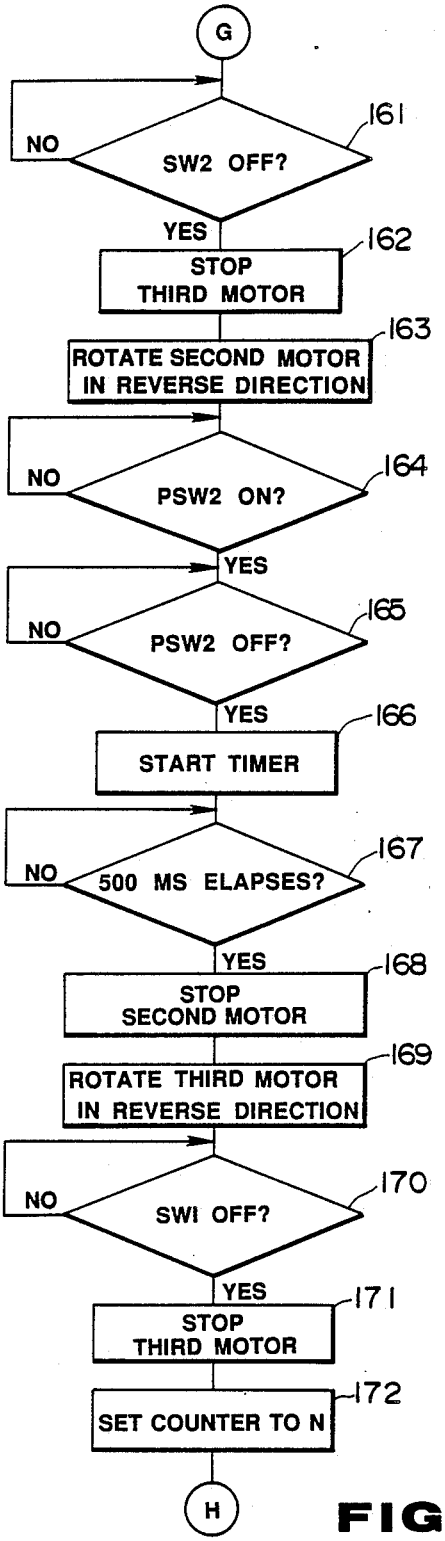

In a case where it is determined at the step 110 in FIG. 6 that an abnormality in the form of two bank notes superposed one above another occurs or in a case where it is determined at the step 112 in FIG. 6 that the conveyed bank notes are abnormal in shape, the program jumps to a step 151 in FIG. 10. If it is determined at the step 151 that the sensors PX1 and PX2 are turned off, the clutch 10 is turned off (step 152) and the brake 18 is turned on (step 153). This causes rotation of the roller 4 and the rollers 19 and 22 to be interrupted whereby drawing of the bank notes from the interior of the bank note receiving portion 2 is interrupted.

Operation of the timer is started after the brake 18 is turned on (step 154) and then the second motor 34 is rotated in the reverse direction after a period of 500 milliseconds elapses (representative of a long period of waiting time enough to allow the bank notes which have been conveyed midway of the conveying passage to be placed on the belt conveyer 31 in a layered structure) (step 156). At the same time, operation of the timer is started (step 157) and rotation of the second motor 34 is interrupted after a period of 100 milliseconds elapses after operation of the timer is started (step 158). Rotation of the second motor 34 in the reverse direction assures that a bank note which may stand upright on the belt conveyer 31 is tilted down flat thereon without fail.

Next, when the third motor 37 is rotated in the normal direction (step 160) and thereby the switch SW2 is turned off (step 161), rotation of the third motor 37 is interrupted (step 162). This permits the thrust roller 35 to be turned down onto the belt conveyer 31 (see FIG. 18). Subsequently, the second motor 34 is rotated in the reverse direction (step 163). After the sensor PSW2 is turned on (step 164) and it is turned off later (step 165), operation of the timer is started and then rotation of the second motor 34 is interrupted after a period of 500 milliseconds elapses (step 168). When the third motor 37 is rotated in the reverse direction after rotation of the second motor 34 is interrupted (step 169) and thereby the thrust roller 35 returns to the waiting position so that the switch SW1 is turned off (step 170), rotation of the third motor 37 is interrupted (step 171). After the counter is later reset to a condition of N, the program returns to the step 105 in FIG. 6, causing bank notes to be drawn from the bank note receiving portion 2 again. Namely, the brake 18 is turned off at the step 107 and the clutch 10 is turned on at the step 108 whereby conveying of bank notes is started from the first again. The foregoing operations are repeated, e.g., by three times. When it is found that bank notes are not correctly dispensed from the apparatus in spite of the three repeated operations in that way, an error signal is generated.

Although the present invention has been described above with respect to the case where it is applied to the bank note dispensing apparatus as constructed in the aforementioned manner, it should of course be understood that it should not be limited only to this but it may be applied to other type of dispensing apparatus adapted to dispense printed papers other than bank notes, e.g., tickets or the like printed matter.

What is claimed is:

1. A method of controlling a printed paper dispensing apparatus comprising:

a first step of drawing printed papers in a printed paper receiving portion from the interior of the printed paper receiving portion one by one;

a second step of detecting an abnormality with the respective printed papers which have been drawn during said first step;

a third step of accumulating the printed papers which have been drawn during the first step so as to allow them to be placed one above another in a layered structure in an accumulating region;

a fourth step of conveying all the printed papers in said accumulating region to a dispensing outlet port after a predetermined period of time elapses after the printed papers have moved past abnormality detecting means, in a case where a predetermined number of printed papers are placed one above another in a layered structure in the accumulating region without an abnormality with the respective printed papers being detected during said second step; and a fifth step of introducing printed papers in said accumulating region into an abnormal printed paper receiving portion after a predetermined period of time elapses after drawing of the printed papers from the printed paper receiving portion during the first step is interrupted, in a case where an abnormality is detected with the respective printed papers during the second step;

a sixth step of inching the printed papers in the accumulating region in the direction opposite to the dispensing outlet port before they are conveyed to the latter.

2. A paper dispensing apparatus comprising:

a paper receiving portion for receiving sheets of paper of a given shape to be dispensed;

drawing means for drawing the sheets of paper in the paper receiving portion one sheet after another at a predetermined interval;

inspecting means for inspecting one sheet after another the sheets of paper drawn by the drawing means;

accumulating means having an accumulating portion, for accumulating in the accumulating portion the sheets of paper which have been inspected by the inspection means;

an outlet port for dispensing therethrough the sheets of paper accumulated in the accumulating portion;

inching means for inching the sheets of paper accumulated in the accumulating portion in a direction opposite to the outlet port when a predetermined number of sheets of paper are accumulated in the accumulating portion;

depressing means, adapted to be turned down onto the sheets of paper accumulated in the accumulating portion, for depressing the sheets of paper from above after the sheets of paper have been inched by the inching means; and conveying means for conveying to the outlet port the sheets of paper in the accumulating portion depressed by the depressing means.

3. The apparatus as claimed in claim 2, wherein the drawing means comprises:

first roller means, having a first roller of a first diameter, for drawing the sheets of paper in the paper receiving portion one sheet after another; and second roller means, having a second roller of a second diameter larger than the first diameter of the first roller of the first roller means, the second roller being disposed down stream of a drawing direction of the first roller means and rotating in synchronism with the rotation of the first roller means.

4. The apparatus as claimed in claim 2, wherein the inspecting means comprises at least two optical sensors arranged adjacent and substantially perpendicular to the paper path so as to detect an abnormality in the form of two sheets of paper superposed one above another and an abnormality of shape of the sheets of paper.

5. The apparatus as claimed in claim 2, wherein the conveying means repeats conveying operations of the sheets of paper at a predetermined interval until the sheets of paper which have been conveyed to the outlet port are picked up.

6. The apparatus as claimed in claim 2, wherein the conveying means performs at least one additional conveying operation to dispense sheets of paper which may have been left in the accumulating portion after sheets of paper which previously have been conveyed to the outlet port are picked up.

7. The apparatus as claimed in claim 2, wherein the accumulating means includes a belt conveyor capable of conveying the sheets of paper in both normal and reverse directions, the inching means inches the belt conveyor in the reverse direction, and the conveying means drives the belt conveyor in the normal direction.

8. A paper dispensing apparatus comprising:

a paper receiving portion for receiving sheets of paper of a given shape to be dispensed;

drawing means for drawing the sheets of paper in the paper receiving portion one sheet after another at a predetermined interval;

inspecting means for inspecting, one sheet after another, the sheets of paper drawn by the drawing means;

accumulating means having an accumulating portion, for accumulating in the accumulating portion the sheets of paper which have received inspection by the inspecting means;

an outlet port for dispensing therethrough the sheets of paper accumulated in the accumulating portion;

an abnormal paper receiving portion for receiving abnormal sheets of paper;

first stop control means for stopping the drawing operation of the drawing means when a desired number of sheets of paper have passed through the inspection means without the inspection means detecting an abnormality of the sheets of paper;

first inching means for inching the sheets of paper accumulated in the accumulating portion in a direction opposite to the outlet port after a predetermined period has passed from the time when the drawing operation is stopped by the first stop control means;

conveying means for conveying the sheets of paper in the accumulating portion to the outlet port after the sheets of paper are inched by the first inching means;

second stop control means for immediately stopping the drawing operation of the drawing means when an abnormality of the sheets of paper is detected by the inspecting means;

second inching means for inching the sheets of paper accumulated in the accumulating portion in a direction opposite to the outlet port after a predetermined period has passed from the time when the drawing operation is stopped by the second stop control means; and introducing means for introducing the sheets of paper accumulated in the accumulating portion into the abnormal paper receiving portion after the sheets of paper are inched by the second inching means.

9. The apparatus as claimed in claim 8, wherein the drawing means comprises:

first roller means, having a first roller, for drawing, one sheet after another, the sheets of paper in the paper receiving means; and second roller means having a second roller with a larger diameter than the diameter of the first roller of the first roller means, the second roller means being disposed at a down stream side of the drawing direction of the first roller means and rotating in synchronism with the rotation of the roller of the first roller means.

10. The apparatus as claimed in claim 8, wherein the inspecting means includes at least two optical sensors arranged adjacent to and substantially perpendicular to the paper path so as to detect an abnormality in the form of two sheets of paper superposed one above another and an abnormality of shape of the sheets of paper passing therethrough.

11. The apparatus as claimed in claim 8, wherein the conveying means repeats the conveying operation of the sheets of paper at a predetermined interval until the sheets of paper conveyed to the outlet port are picked up.

12. The apparatus as claimed in claim 8, wherein the conveying means performs at least one additional conveying operation for dispensing sheets of paper which may have been left in the accumulating portion after sheets of paper which previously have been conveyed to the outlet port are picked up.

13. The apparatus as claimed in claim 8, wherein in a case where abnormal sheets of paper are introduced into the abnormal paper receiving portion by the introducing means, dispensing operations for the sheets of paper are restarted from the beginning and are repeated at predetermined times until the predetermined number of sheets of paper are dispensed correctly.

14. The apparatus as claimed in claim 8, further including depressing roller means, adapted to be turned down onto the sheets of paper accumulated in the accumulating portion, for depressing the sheets of paper from above, when the sheets of paper in the accumulating portion are conveyed to the outlet port as well as when they are introduced into the abnormal paper receiving portion.

15. The apparatus as claimed in claim 8, wherein the accumulating means includes a belt conveyor capable of conveying the sheets of paper in both normal and reverse directions, the first and second inching means inch the belt conveyor in the reverse direction, the conveying means drives the belt conveyor in the normal direction, and the introducing means drives the belt conveyor in the reverse direction.

16. A method of controlling a paper dispensing apparatus comprising:

a first step of drawing sheets of paper of a given shape in a paper receiving portion one sheet after another;

a second step of inspecting the sheets of paper drawn in the first step;

a third step of accumulating the sheets of paper drawn in the first step so as to allow them to be placed one sheet above another in a layered structure in an accumulating portion;

a fourth step of inching the sheets of paper accumulated in the accumulating portion in a direction opposite to an outlet port after a predetermined period of time has passed, when a desired number of sheets of paper are accumulated in the accumulating portion without the second step detecting an abnormality of the sheets of paper;

a fifth step of conveying the sheets of paper accumulated in the accumulating portion to the outlet port; and a sixth step of immediately stopping the drawing operation in the first step when an abnormality is detected in the second step, and after a predetermined period of time has passed introducing the sheets of paper accumulated in the accumulating portion.

17. The method as claimed in claim 16, further comprising a seventh step of repeating conveying operations of the sheets of paper at a predetermined interval until the sheets of paper which have been conveyed to the outlet port are picked up.

18. The method as claimed in claim 16, further comprising an eighth step of performing at least one additional conveying operation of sheets of paper which may have been left in the accumulating portion after the sheets of paper which previously have been conveyed to the outlet port are picked up.

19. The method as claimed in claim 16, further comprising a ninth step of restarting dispensing operations of the sheets of paper from the first step when the abnormal sheets of paper are introduced into the abnormal paper receiving portion by the introducing means and repeating the dispensing operations a predetermined number of times until a predetermined number of sheets of paper are dispensed correctly.

* * * * *